US006073802A

United States Patent [19]

Sampson et al.

[11] Patent Number: 6,073,802

[45] Date of Patent: Jun. 13, 2000

[54] EMERGENCY CLOSURE GATE

[76] Inventors: Darwin L. Sampson, 912 Barlow Dr., Salina, Kans. 67401-8405; Greg C. Myers, 208 W. Charlotte, Salina, Kans. 67401; Brian E. Koster, 47 N. 60th Rd., Tescott, Kans. 67484

[21] Appl. No.: 09/238,371

[22] Filed: Jan. 27, 1999

[51] Int. Cl.[7] ..... B67D 3/00

[52] U.S. Cl. ..... 222/54; 222/52; 222/63; 222/504; 222/502; 222/511; 222/561

[58] Field of Search ..... 222/491, 495, 222/504, 511, 514, 561, 52, 63, 54, 502

[56] References Cited

U.S. PATENT DOCUMENTS 3,733,012 5/1973 Grun ..... 222/504 X 4,470,524 9/1984 Semenenko ..... 222/504 X 5,351,864 10/1994 Semenenko et al. ..... 222/504

5,799,825 9/1998 Dillman ..... 222/504 X

*Primary Examiner*—Kevin Shaver

*Assistant Examiner*—Thach Bui

*Attorney, Agent, or Firm*—Spencer Fane Britt & Browne LLP

[57] ABSTRACT

An emergency closure for use in grain storage facilities, the emergency closure utilizes a fail-safe closure mechanism such that upon the termination of motive force to the gate the gate is forced into a closed position to terminate the flow of grain or other flowable substance out of it container.

13 Claims, 6 Drawing Sheets

EMERGENCY CLOSURE GATE

BACKGROUND

The present invention relates to a closure gate for a grain storage bin or silo which will automatically close upon the occurrence of an explosion or other critical condition in the area of a grain silo or grain handling area. In general, the closure gate of the present invention will remain closed unless a motive force is applied to move the gate into an open position. Upon cessation of the motive force, the gate will return to its closed position to cut off the flow of grain out of the bin or elevator silo.

In the grain storage industry, the storage handling and processing of large quantities of grains presents the existence of grain dust in and around the storage and processing facility. Grain dust is a substantial problem for grain handling facilities as the presence of grain dust constitutes a combustible material which can undergo ignition and burn at such a rate as to result in explosive combustion of the grain dust in the vicinity of the ignition point. In general, once the concentration of grain dust in an area reaches a critical level, it can be ignited in a number of different ways. The ignition sources identified as providing the highest probability of grain dust ignition are hot bearings, welding and cutting activities in the vicinity of the grain dust, conveyor belt slippage and misalignment, open flames, and foreign objects caught in machinery resulting in overheating. The ignition sources presenting a low probability of grain dust ignition are considered to be spontaneous combustion, static electricity, lightening and metal and stone sparks.

While the existence of grain dust cannot be eliminated in grain handling operations, the accumulation of grain dust can be prevented and procedures to control grain dust are a major aid in preventing explosions in grain handling facilities. To control grain dust, various "housekeeping" procedures are required within the grain handling areas. These housekeeping procedures consist of keeping grain transfer points and grain free fall areas dust tight or providing dust control for these areas. The ultimate object being to maintain any layer of grain dust in an area at less than one sixty fourth inches and an airborne concentration to less than 40 grams per cubic meter. If the amount of grain dust is kept below these parameters, it is generally believed that the concentration of grain dust is too low for dust ignition and explosive combustion to occur.

Though the above safety parameters have been known for some time, it nevertheless occurs from time-to-time that grain dust concentration becomes elevated and ignition of the grain dust results in explosive combustion in the grain storage facility. Such explosions generally cover a wide area of enclosed space, and the explosive force is devastating both in terms of human life and damage to the storage facility.

One of the causes of loss of life during a grain elevator explosion is from damage to the grain containment equipment resulting in the unrestrained flow of huge volumes of grain into the work areas of the grain storage facility. These "avalanches" of grain into the areas where humans are working can bury the workers under tons of grain. Such a disaster can cause rapid loss of life, and at a minimum, the obstruction of assistance reaching the workers affected by the explosion.

One manner in which this avalanche of grain occurs can be appreciated by reference to FIG. 2 showing a typical configuration of a grain storage facility. The grain storage silo 12 is situated above a tunnel area 18 containing grain-handling equipment and workers operating the grain equipment. Upon the occurrence of an explosion in tunnel 18, chute 20 can be torn from the ceiling of tunnel 18 allowing the grain in silo 12 to plunge into tunnel 18. It is in this circumstance that workers in tunnel 18 become buried in tons of grain.

Current grain handling structures are not equipped with any gates or closures which can close upon danger to chute 20 and prevent this catastrophic deluge of grain.

SUMMARY OF THE INVENTION

Therefore, it is an object of the present invention to provide a grain silo grain gate which will automatically cut off the flow of grain out of a storage bin upon the occurrence of an explosion or critical event in the vicinity of the grain bin.

It is another object of the present invention to provide a gate for a grain storage bin having sufficient strength to withstand the force generated in lower impact grain explosions and thereby continue functioning to interrupt the flow of grain from the storage bin.

It is yet another object of the present invention to provide an explosion gate for a grain storage bin which will shut off the flow of grain from the grain bin on the occurrence of an explosion through the gate closure being responsive to the interruption of emotive force to the gate holding the gate open for flow of grain.

It is an object of the present invention to provide a closure for a storage container which will shut off the flow of material out of the container in response to events or conditions which occur within the container or in the surrounding environment or both.

It is another object of the present invention to provide a closure for a storage container, such as a grain storage silo or the like, which requires an applied force to move the closure to an open position to permit the flow of a stored substance out of the bin and which closure will automatically close upon the interruption of the applied opening force.

Still another object of the present inventions is to provide a closure for a storage container which is biased or spring biased into the closed position so that the gate will close in response to the sensing of the presence of preselected conditions within the storage container or in the environment adjacent the storage container resulting in the termination of a force overcoming the biasing of the gate in to the closed position.

Yet another object of the present invention is to provide a closure for a storage container which will close in response to the occurrence of an explosion.

Yet another object of the present inventions is to provide a closure for a storage container which will close in response to the sensing of high airborne particulates.

Still another object of the present inventions is to provide a closure for a storage container which will close in response to the sensing of high temperatures.

Another object of the present inventions is to provide a closure for a storage container which will close in response to the occurrence of high air pressure such as that caused by a grain dust explosion.

Yet another object of the present inventions is to provide a closure for a storage container which will close in response to the rupture of hoses or lines which transmit the force needed to place the closure into the open position.

These objects and other benefits can be obtained by a closure for a grain storage container comprising a gate or closure mechanism having an action tending to force the gate into the closed position in the absence of a force which must be applied to maintain the gate in an open position. The force applied to maintain the gate in an open position is subject to interruption on the occurrence of a variety of critical events such as high temperature atmosphere or equipment, high pressure such as explosive pressure, high air particulate concentration or the loss of water, natural gas or electricity to the grain facility. On the occurrence of such a critical event the force applied to maintain the gate in an open position is terminated and the gate closes to end the flow of grain.

The foregoing and other objects are not meant in a limiting sense, and will be readily evident upon a study of the following specification and accompanying drawings comprising a part thereof. Other objects and advantages of this invention will become apparent from the following description taken in connection with the accompanying drawings, wherein is set forth by way of illustration and example, an embodiment of this invention.

DESCRIPTION OF THE DRAWINGS

A preferred embodiment of the invention, illustrative of the best modes in which the applicant has contemplated applying the principles, are set forth in the following description and are shown in the drawings and are particularly and distinctly pointed out and set forth in the appended claims.

DETAILED DESCRIPTION

Figure 1:
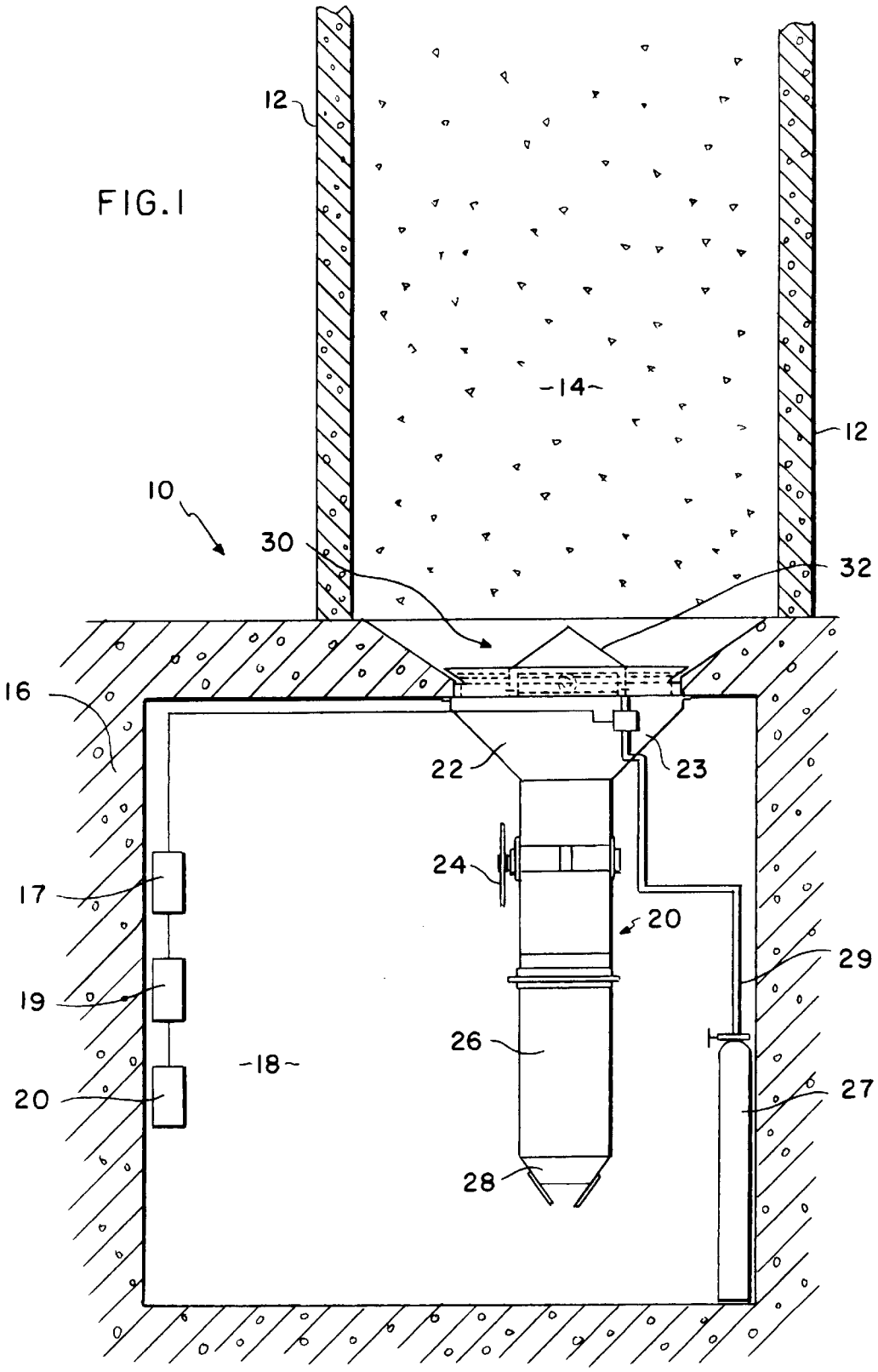
FIG. 1 is a cross-sectional elevational view of a grain storage elevator showing the work tunnel area underneath the grain storage silo and the spout structure for directing grain out of the silo and down into the work tunnel area.

Referring now to FIG. 1, the structure generally referred to as a grain elevator is shows in schematic cross-sectional view. The grain elevator comprises grain silo 12 holding grain 14 and which is positioned above work tunnel 18. Tunnel 18 is isolated from silo 12 by tunnel side walls 16. Grain 14 is transferred from grain silo 12 by gravity flow into spout 20 through spout funnel 22 which is controlled by flow valve 24. When flow valve 24 is opened, the grain enters chute 26 and exits by spout nozzle 28 into awaiting cartage vehicles or into a bucket conveyor line which is located below spout nozzle 28 and which is not shown in the drawings.

Figure 2:
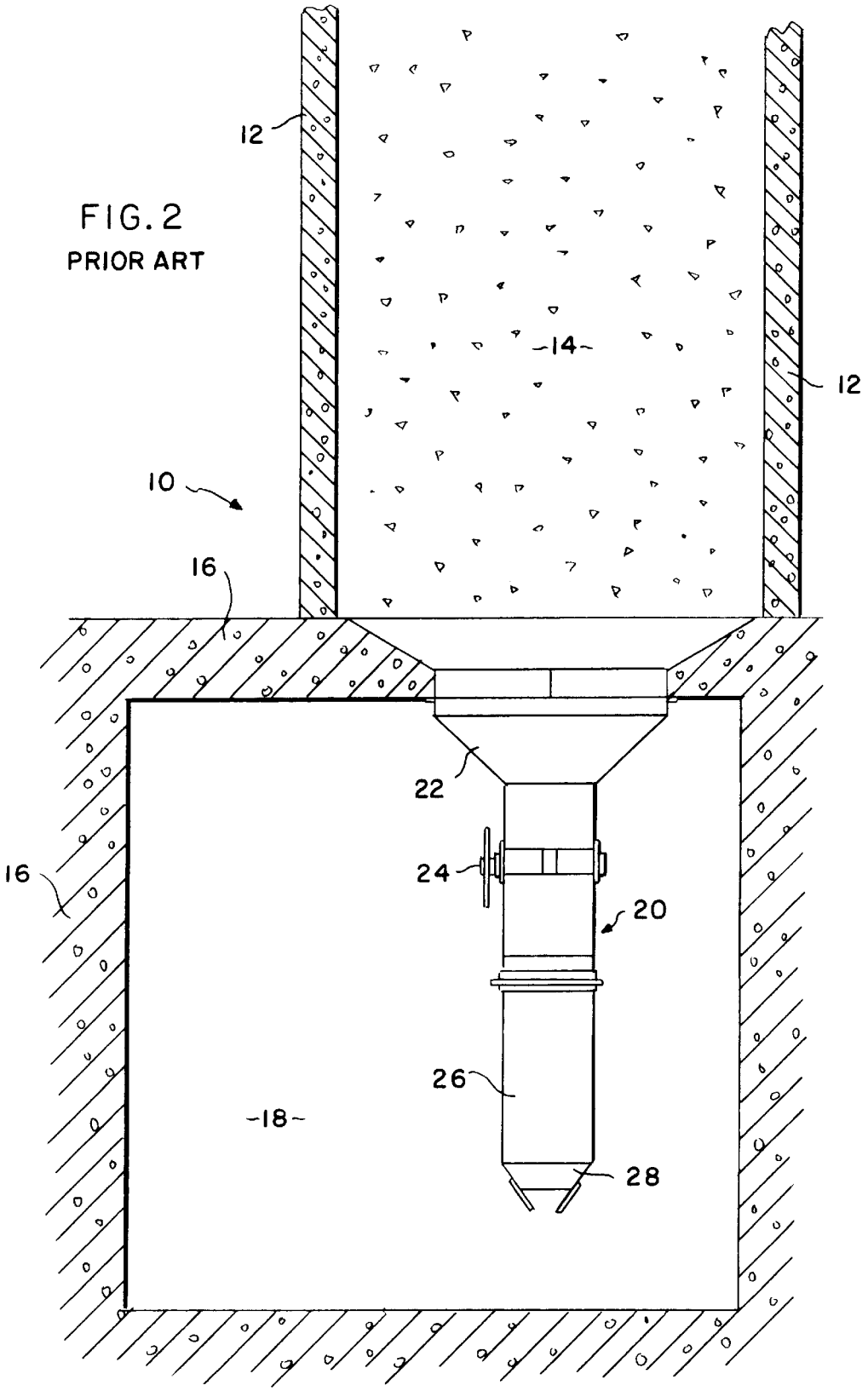
FIG. 2 PRIOR ART
FIG. 2 is a cross-sectional elevational view of the grain storage elevator shown in FIG. 1 and showing, generally, the prior art structure.

Referring now to FIG. 2, the prior art grain elevator structure is shown. A comparison of FIG. 2 to FIG. 1 will reveal that the previously described structure is present in the prior art. Emergency closure gate 30 (FIG. 1) has been inserted above spout funnel 22 and which grain 14 must pass through gate 30 in order to reach spout 20. The placement of emergency closure gate 30 in this position locates it in a protected area of the structure, specifically concrete structure of tunnel sidewall 16. This placement is important and useful as it permits emergency closure gate 30 to avoid much of the damage which can be caused by a grain dust explosion occurring within work tunnel 18 while placing emergency closure gate 30 in a position to cut off the flow of grain from grain silo 12 and into tunnel 18.

As generally described previously, the occurrence of a grain explosion in work tunnel 18 often results in damage or complete elimination of spout 20. When this occurs, there often is nothing in place to stop the flow of grain 14 from silo 12 into work tunnel 18. The resulting avalanche of grain 14 into tunnel 18 will bury and suffocate any workers located in work tunnel 18 who have survived the grain dust explosion. As previous grain dust explosions document, much of the loss of life is the result of grain 14 filling work tunnel 18 and preventing emergency rescuers from reaching workers in tunnel 18 who have survived the grain dust explosion. Therefore, it will be appreciated that the presence of an emergency closure gate 30 which can withstand the explosion and immediately shut off the flow of grain from elevator 12 to tunnel 18 can substantially improve the opportunities for survival of workers in tunnel 18 and assist the ability of rescue and emergency personnel in maintaining a clear pathway to the injured grain elevator workers.

Figure 3:
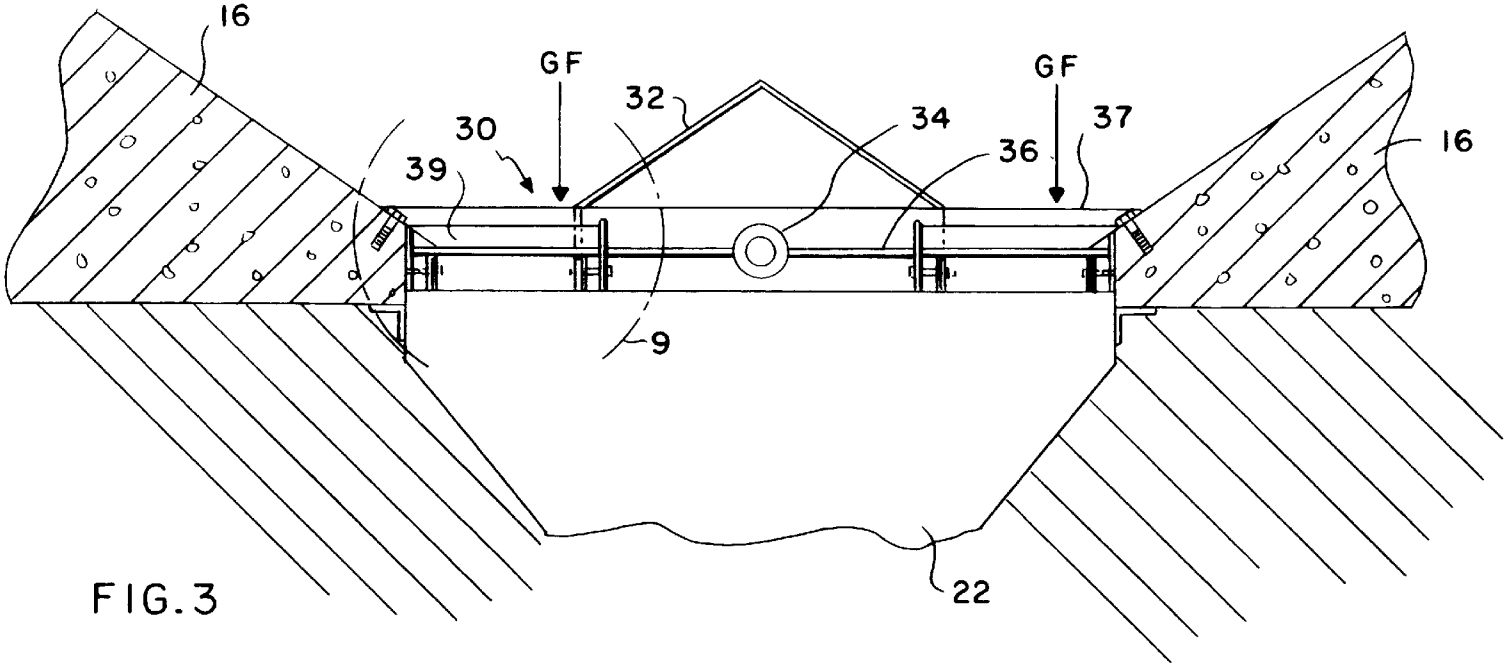
FIG. 3 is a cross-sectional view taken along line 3—3 of FIG. 5 and including fragments of the adjacent environmental structure and cap 32 shown in FIG. 1.

The structure and operation of emergency closure gate 30 will now be described in detail by reference to FIGS. 1 through 9. Referring now to FIG. 3, emergency closure gate 30 is shown in cross-sectional view. The cross-sectional view is taken along line 3—3 of FIG. 5 and the adjacent environmental structure and cap 32 shown in FIG. 1 have been included for clarity. As shown in FIG. 3, emergency closure gate 30 is located directly above spout funnel 22 of spout 20 (FIG. 1) and emergency closure 30 is attached to the sidewalls of tunnel 18 structure containing an opening void which allows grain 14 of silo 12 (FIG. 1) to flow into spout 20 of work tunnel 18. Often, as shown in FIG. 1, this void is constructed within tunnel sidewall 16. Emergency closure 30 is secured to sidewall 16 by support 37 which is bolted to tunnel sidewall 16. This serves to support emergency closure gate 30 in the relatively protected area above work tunnel 18.

Still referring to FIG. 3, the location of pressure cylinder 34 is shown in emergency closure 30. Pressure cylinder 34 is protected from grain 14 by cylinder cap 32. Cap 32 also serves to direct the flow of grain to either side of pressure cylinder 34. This directing of the grain flow by cap 32 and sidewall 16 directs the grain into the grain flow areas designated by arrow GF on either side of cap 32. As will be described in greater detail hereinafter, pressure cylinder 34 of emergency closure 30 operates sliding gate plate 36 which is attached to pressure cylinder 34. It is the movement of sliding gate plate 36 which opens or closes voids in emergency closure gate 30 to permit the flow, or termination of flow, of grain from grain silo 12 into spout funnel 22.

Figure 4:
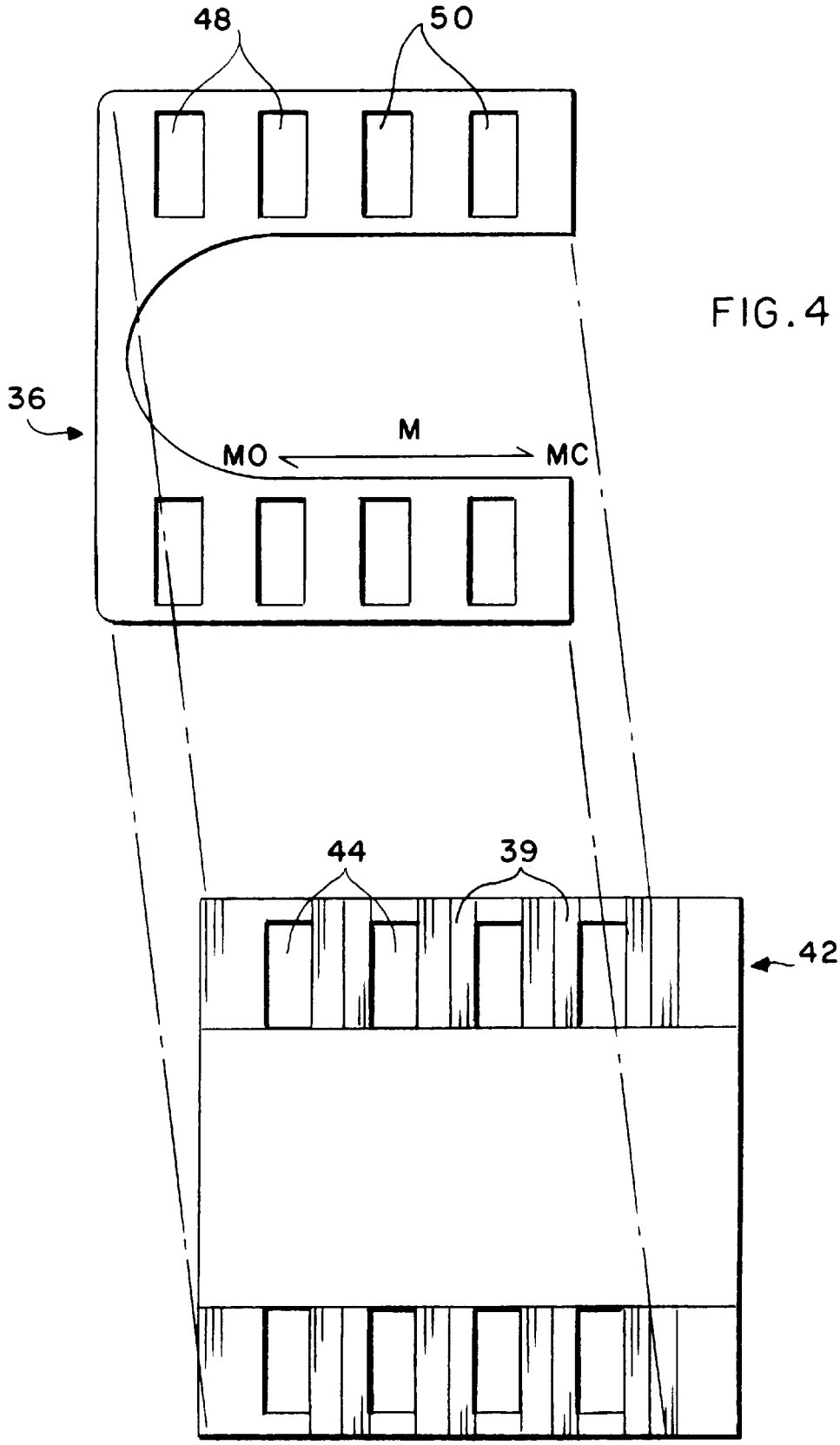
FIG. 4 is an exploded plan view of the sliding gate plate which moves relative to the flow director plate to open or close voids in the flow director plate to allow the flow of grain through the emergency closure gate or to cut off grain flow.
Figure 6:
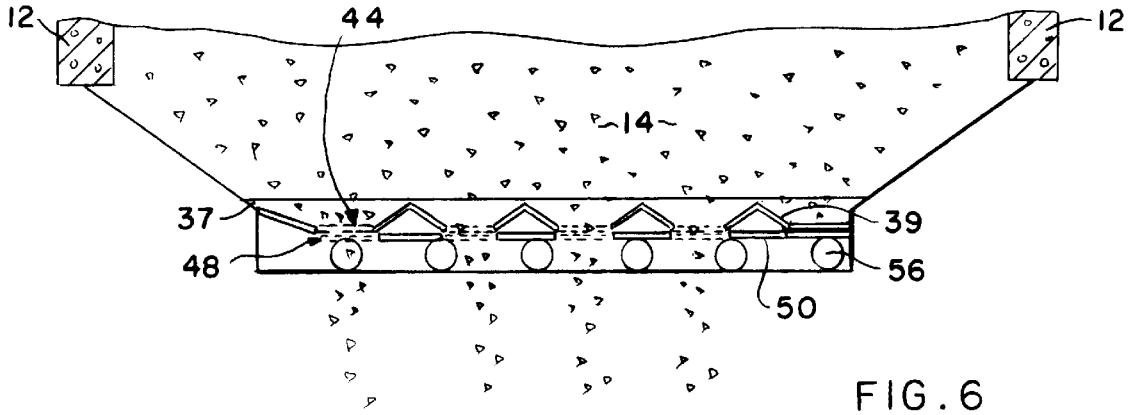
FIG. 6 is a cross-sectional elevation view taken along line 6—6 of FIG. 5 and showing the sliding gate plate in open position to allow the flow of grain through the emergency closure gate.

Referring now to FIG. 4, the relative movements between sliding gate 36 and flow plate 42 will be described in order to distinguish the positioning of the structures to create the situation in which grain is allowed to flow through emergency closure 30 versus the situation in which grain is prevented from flowing through emergency closure 30. In FIG. 4, an exploded view is presented showing the relationship of the sliding gate plate 36 to flow plate 42. In use, flow plate 42 rests just above sliding gate plate 36. The view shown in FIG. 4 has been inverted for clarity and the underneath face of flow plate 42 and sliding gate plate 36 are shown. The actual relationship can be seen in FIG. 3 where sliding gate plate 36 is attached to pressure cylinder 34. Flow director 39, in the cross-sectional view of FIG. 6, is shown to have a "peaked" cross-sectional shape and can be seen projecting upwardly in FIG. 6.

Again referring to FIG. 4, it will be appreciated that, depending upon the position of sliding gate plate 36 with respect to flow plate 42, flow director voids 44 in flow plate 42 can be blocked by plate closures 50 of sliding gate plate 36. Alternatively, flow director voids 44 of flow plate 42 can remain unobstructed as is the case when sliding gate plate 36 is positioned so that plate voids 48 are underneath flow director voids 44.

This opening and closing of flow director void is accomplished through operation of pressure cylinder 34 (FIG. 5) which is attached to sliding gate plate 36 so that operational arm 54 (FIG. 5) of pressure cylinder 34 can move sliding gate plate in the directions indicated by Arrow M of FIG. 4. As can be better appreciated by referring, generally, to FIG. 5 and FIG. 8 the movement of sliding gate plate 36 relative to flow plate 42 in the directions indicated by Arrow M of FIG. 4 will serve to either create a void allowing the flow of grain through emergency closure gate 30, or will block flow director voids 44 by plate closure 50 thus terminating the flow of grain. In FIG. 4, the directions of movement of sliding gate plate 36 to achieve this flow, or cessation of flow of grain, is indicated by Arrow M. Movement of sliding gate plate 36 in the direction of Arrow MC, corresponds to the position of the gate 30 shown in FIG. 8 which is the closed position. Alternatively, movement of sliding gate plate 36 in the direction of Arrow MO positions sliding gate plate 36 relative to flow plate 42 in the position shown in FIG. 5 which is the open position allowing the flow of grain through flow director voids 44 and into spout 22 (FIG. 3).

Figure 5:
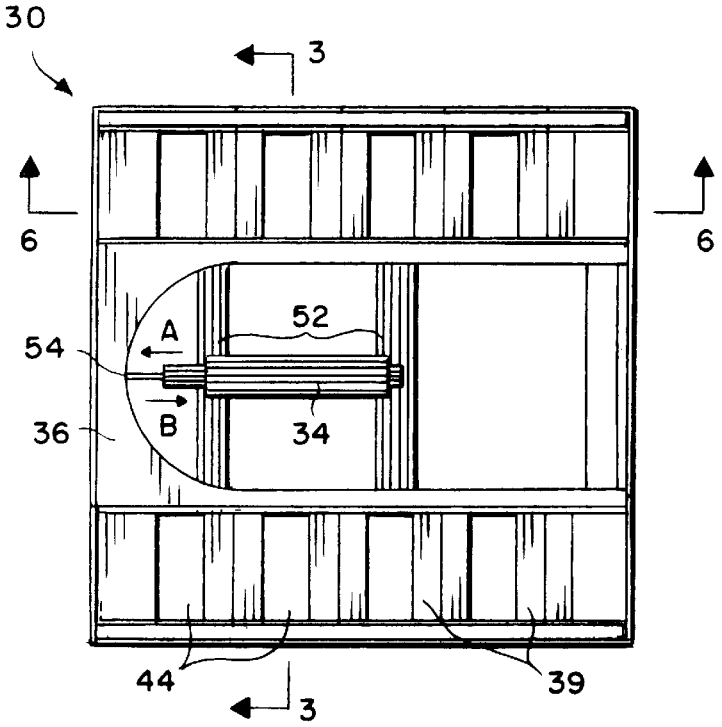
FIG. 5 is a top plan view of the emergency closure gate with the cap and the environmental structure removed and showing the sliding gate plate in the open position allowing grain to flow through the emergency closure gate.

Referring now to FIG. 5, the operation of emergency closure gate 30 will be described. In FIG. 5, pressure cylinder 34 is shown secured to the frame of emergency closure gate 30 by attachment of cylinder 34 to cylinder mounting supports 52. Cylinder arm 54 of pressure cylinder 34 is attached to sliding gate plate 36. Cylinder arm 54 is operable in the directions indicated by arrows A and B shown in FIG. 5 adjacent to cylinder arm 54. When cylinder 34 is pressurized, either by hydraulic pressure or pneumatic pressure, cylinder arm 54 moves in the direction indicated by Arrow A. When cylinder arm 54 moves in the direction of Arrow A in the preferred embodiment, sliding gate 36 is pushed into the open position and the relationship between sliding gate plate 36 and flow plate 42 is as shown in FIG. 6. In this way, the open position of the present invention is achieved and grain 14 can flow through emergency closure gate 30 and into spout funnel 22 (FIG. 1). It will be appreciated that to have emergency closure gate operate as an emergency shutoff for the flow of grain, it is important that emergency closure gate be actively operated to maintain the gate in the open position to allow the flow of grain. That is, should an emergency or disaster occur in the grain elevator facility, it is of particular importance that the interruption of any selected critical service to the grain elevator facility, such as water or electricity or natural gas, or the occurrence of selected unusual events, high temperature at a particular location, high air particulates, explosive pressure, or separation of spout funnel 22 from tunnel 16, that emergency closure gate 30 automatically shut to suspend the flow of grain from grain silo 12 and into work tunnel 18. This is result is accomplish, generally, by having closure gate 30 biased, or forced, into the closed position by use of a spring mechanism or other active force which tends to move gate 30 into the closed position unless a counter force is applied to move gate 30 into the open position.

A number of different mechanisms may be employed for operating gate 30 in this automatic manner. In the preferred embodiment of FIG. 5, this is accomplished by use of pressure cylinder 34 which is internally spring loaded such that without application of a pressure force to cylinder 34, cylinder 34 remains in a contracted position and sliding gate plate 36 is positioned in the closed position shown in FIG. 8.

To further clarify this functioning of pressure cylinder 34, with reference to FIG. 5, it will be appreciated that the spring mounted in pressure cylinder 34 operates to force cylinder arm 54 in the direction of Arrow B at all times. In order to overcome the force of the spring loaded in pressure cylinder 34, and to move cylinder arm 54 in the direction of Arrow A it is necessary that a positive pressure be applied to the cylinder to move cylinder arm 54 in the direction of Arrow A and to hold cylinder arm 54 in that position in order to permit the flow of grain through flow deflector voids 44 as shown in FIG. 6.

Figure 8:
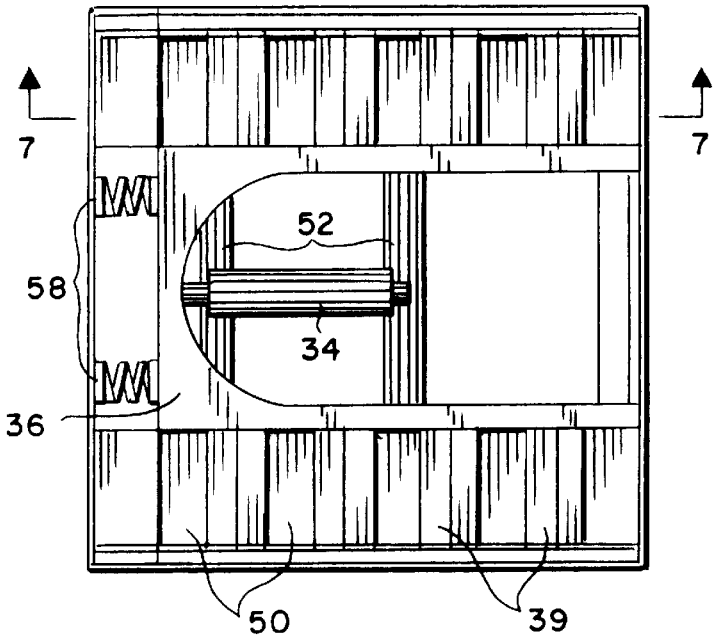
FIG. 8 is the top plan view of the emergency closure gate of FIG. 5 with sliding gate plate in the closed position preventing grain from flowing through the emergence closure gate and showing an alternative embodiment using an external spring to shut the closure gate.

It will be appreciated by those skilled in the art that a number of alternatives exist for effecting this type of "passive closure" embodiment. By way of example and not limitation, it will be appreciated that the spring mechanism utilized in pressure cylinder 34 could be separated from the structure of pressure cylinder 34 and moved to a point of attachment anywhere on sliding gate plate 36 which would serve to force sliding gate 36 into a closed position under the effect of the natural tendency of the spring to expand or contract to achieve its relaxed position. One embodiment of such an external spring is shown in FIG. 8 where spring 58 operates to continually force gate 36 closed.

Alternatively, a second pressurized cylinder system could be added to the preferred embodiment of FIG. 5 wherein the second pressurized cylinder constantly pushes in the direction of Arrow B to force the sliding gate plate 36 into a closed position. In this circumstance, pressure cylinder 34, when activated, would overcome the pressure of this second cylinder's pressure by pushing with greater force in the direction of Arrow A to open the emergency closure gate. In this two-cylinder situation, the occurrence of a catastrophic event would either signal the shutdown of cylinder 34, or would cut off the motive force operating cylinder 34 and the second cylinder operating in the direction of Arrow B would function to force the gate closed.

However, in the instance where a fail-safe emergency closure gate is preferred, it is simpler and more reliable to adopt a simple mechanical closure of a pressure spring whether mounted in pressure cylinder 34 or mounted in direct attachment to sliding gate plate 36, in order to assure that upon the occurrence of power or pressure failure or other signaling event, it will be the natural tendency of emergency closure gate 30 to adopt a closed position cutting off the flow of grain from grain silo 12.

Referring now to FIG. 6, emergency closure gate 30 is shown in cross-sectional view taken along line 6—6 of FIG. 5 and showing sliding gate plate 36 positioned with respect to flow plate 42 to cause alignment between flow director voids 44 and plate voids 48 to permit the flow of grain from grain silo 12 and through the voids 44 and 48 of emergency closure gate 30 and allow the grain into funnel 22 (FIG. 1). As seen in FIG. 6, the movement of sliding gate plate 36 is assisted by rollers 56 which rotate in response to the movement of sliding gate 36 to allow supported, easy movement of sliding gate plate 36 between open position shown in FIG. 6 and closed position shown in FIG. 7.

Figure 7:
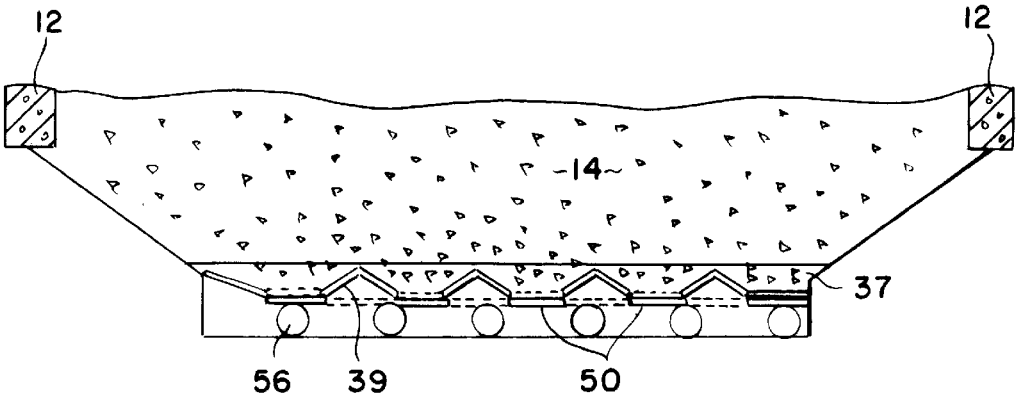
FIG. 7 is a cross-sectional elevation view taken along line 7—7 of FIG. 8 and showing the sliding gate plate in closed position to stop the flow of grain through the emergency closure gate.

Referring now to FIG. 7, a cross-sectional view taken along line 7—7 of FIG. 8 is shown. In FIG. 7 sliding gate plate 36 has been moved into the closed position such that plate closures 50 now block flow director voids 44 to terminate the passage of grain 14 from grain silo 12 through emergency closure gate 30 and into spout funnel 22. The closed configuration of FIG. 7 is also shown in plan view in FIG. 8. In FIG. 8, pressure cylinder 34 is in its contracted position caused by the internal spring in pressure cylinder 34 forcing cylinder arm 54 in the direction of Arrow B (FIG. 5) to slide gate plate 36 into the closed position to terminate the flow of grain. Again, referring to FIGS. 6 and 7 it is shown that on flow plate 42 are "peaked-shaped" flow directors 39 which serve to direct the flow of grain toward flow director voids 44.

Referring now to FIG. 8, emergency gate 30 is shown in its closed position where sliding gate plate 36 has been pressed into a position such that plate closures 50 of gate plate 36 have been interposed to cover flow director voids 44 (FIG. 6) to terminate the passage of grain through emergency closure gate 30. As previously discussed, this closure of emergency gate 30 is intended to operate in a fail-safe manner, meaning that when active motive force is interrupted, it is the natural tendency of the gate, through its operation and construction, to return to a closed position such that the flow of grain through gate 30 is terminated. As identified previously, an alternate method from the use of a spring within pressure cylinder 34 would be the use of an external spring mounted so as to force sliding gate plate 36 into a closed position. Such an external spring option has been shown in FIG. 8 as external spring 58. The location of spring 58 indicates how such an external spring can be positioned to effect automatic closure of sliding gate plate 36 to terminate the flow of grain or the like through emergency closure gate 30.

Figure 9:
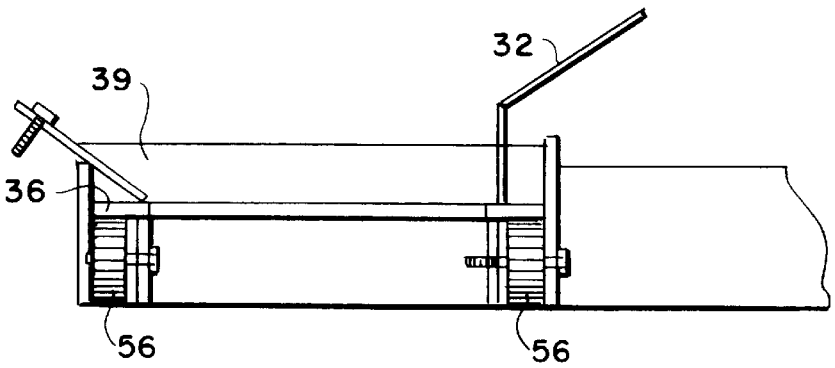
FIG. 9 is an enlarged fragmentary view of FIG. 3 showing the rollers on which the sliding gate plate moves in response to the actions of the pressure cylinder to open or to close the voids allowing grain flow through the emergency closure gate.

Referring now to FIG. 9, the support of sliding gate 36 on rollers 56 is shown in detail. In FIG. 9 it can be seen that flow director 39 is extending upwardly above sliding gate plate 36 which moves back and forth just below flow director 39 by a sliding movement supported and assisted by rollers 56. Rollers 56 serve to reduce the amount of force required to open and close emergency closure gate 30 by allowing sliding gate plate 36 to move on rollers or bearings 56.

As previously stated, emergency closure 30 is intended to operate on a fail-safe type mechanism where force must be exerted to hold sliding gate plate 36 in an open position to allow the flow of grain therethrough. Once active motive force is cut off in some manner, the sliding gate plate 36 should close terminating grain flow through emergency closure 30. Such a cutoff of the active force utilized to hold emergency pressure gate 30 in the open position can be achieved or signaled in a number of different ways.

Referring again to FIG. 1, the active force utilized to hold emergency closure gate 30 in the open position is shown as a pressurized gas supply of air tank 27 which is connected to pressure cylinder 34 of emergency closure 30 by pressure line 29. Those skilled in the art will recognize that alternative methods of providing pneumatic pressure such as a compressor will be interchangeable with air tank 27 and that a hydraulic pressure system may be equivalently substituted for the pneumatic system. Pressure line 29 is provided with valve 23 which can cut off the flow of pressure from tank 27 to pressure cylinder 34.

Still referring to FIG. 1, various sensors or detection means responsive to a critical event can be employed to effect closure of valve 23 when critical circumstances are detected within the grain silo 12 or tunnel 18. In the present embodiment the sensors are shown placed in tunnel 18 where personnel are most likely to be located. The various types of sensors which might be utilized to effect the shut off of pressure from tank 27 by closure of valve 23 are pressure sensor 17, air particulates (grain dust) sensor 19 and/or temperature sensor 20. Use of these three sensors, either separately or together could be relied on to indicate various critical environmental factors which would dictate that grain flow be shut off. By way of example and not limitation, a pressure sensor might be used to deal with the circumstance in which a grain explosion occurs and a sudden increase of pressure is detected by pressure sensor 17. Such an increase in pressure, while not sufficient to damage spout 20 or funnel 22, might be sufficient to indicate that a critical situation had arisen and that grain flow should be shut off. In this instance the signal from pressure detector 17 would close valve 23 and a spring or pressure cylinder would cause sliding gate to be closed cutting off the flow of grain. Alternatively, a particulate sensor 19 might be utilized in tunnel 18. Particulate sensor 19 could be utilized to determine the amount of grain dust present in the atmosphere in tunnel 18 and should the amount of grain dust in tunnel 18 reach a preselected critical level this would be detected by particulate sensor 19 and it would signal valve 23 to close resulting in the closure of emergency closure gate 30. Yet another alternative for closure of gate 30 would be the use of a temperature gauge within tunnel 18 or other areas of the grain complex which would determine whether overheating or fire conditions were present. On the occurrence of such overheating conditions, valve 23 would be closed by a signal from temperature sensor 20 and the flow of grain terminated. It will be appreciated that the location of temperature sensor 20 might be adjacent to machinery and bearings which might have a tendency to heat up during a malfunction and cause ignition of grain dust. Such temperature sensors could be placed on machinery or bearings or belts used in grain handling and thus serve to detect a high temperature situation which might lead to the ignition of grain dust.

Another, more drastic, alternative means responsive to a critical event exists for effecting closure of emergency gate 30 through the interruption of pressure to pressure cylinder 34. This alternative is the rupture of pressure line 29 as a result of a catastrophic explosion in tunnel 18. In such a circumstance, it is possible that the explosive force in tunnel 18 could separate spouting 20 from tunnel wall 16. In such an event, pressure line 29 would be torn away from its position and ruptured, thus terminating the active or motive pressure to cylinder 34 and causing emergency closure gate to close and terminate the flow of grain.

We claim:

1. An emergency closure for a grain storage bin comprising:

a gate mounted in the storage bin, said gate being movable between an open grain-releasing position and a closed grain-retaining position, means for biasing said gate into said closed position, means for overcoming said biasing means to force said gate into said open position, and means responsive to a critical event for terminating operation of said means for overcoming such that said gate is returned to said closed position by action of said biasing means.

2. An emergency closure for a grain storage bin comprising:

a gate for mounting on the storage bin, said gate being movable between an open position and a closed position, means for motivating said gate into said open position to allow flow of material out of the bin, means for forcing said gate into said closed position, and means responsive to an explosive force for terminating operation of said means for motivating such that said gate is moved into said closed position by said means for forcing said gate into said closed position.

3. The apparatus as claimed in claim 2, wherein said means for motivating is a pressure responsive cylinder operating to force said gate into said open position.

4. The apparatus as claimed in claim 3, wherein said means for motivating is a pneumatic cylinder.

5. The apparatus as claimed in claim 3, wherein said means for motivating is a hydraulic cylinder.

6. The apparatus as claimed in claim 2, wherein said means for forcing is a pressure responsive cylinder operating to force said gate into said closed position.

7. The apparatus as claimed in claim 6, wherein said means for forcing is a pneumatic cylinder.

8. The apparatus as claimed in claim 6, wherein said means for forcing is a hydraulic cylinder.

9. The apparatus as claimed in claim 2, wherein said means responsive to an explosive force is rupture of a pressure hose leading to said means for motivating.

10. The apparatus as claimed in claim 2, wherein said means responsive to an explosive force is pressure responsive switch.

11. The apparatus as claimed in claim 2, wherein said means responsive to an explosive force is noise responsive switch.

12. The apparatus as claimed in claim 2, wherein said means responsive to an explosive force is heat responsive switch.

13. The apparatus as claimed in claim 2, wherein said means for forcing is spring for maintaining said gate in said closed position.

* * * * *